US007681622B2

(12) United States Patent
Sherman

(10) Patent No.: US 7,681,622 B2
(45) Date of Patent: Mar. 23, 2010

(54) HETEROGENEOUS COMPOSITE BODIES WITH ISOLATED LENTICULAR SHAPED CERMET REGIONS

(76) Inventor: Andrew J. Sherman, 9181 Royer La., Cirtland Hills, OH (US) 44060

( * ) Notice: Subject to any disclaimer, the term of this patent is extended or adjusted under 35 U.S.C. 154(b) by 857 days.

(21) Appl. No.: 11/473,962

(22) Filed: Jun. 23, 2006

(65) Prior Publication Data

US 2007/0141270 A1 Jun. 21, 2007

Related U.S. Application Data

(62) Division of application No. 11/099,857, filed on Apr. 6, 2005.

(60) Provisional application No. 60/560,405, filed on Apr. 8, 2004.

(51) Int. Cl.
*B22D 23/00* (2006.01)
*B05D 1/02* (2006.01)
*C23C 4/04* (2006.01)

(52) U.S. Cl. ..... 164/46; 427/446; 427/455; 427/456

(58) Field of Classification Search ..... 164/46; 427/446, 455, 456
See application file for complete search history.

(56) References Cited

U.S. PATENT DOCUMENTS 3,617,358 A * 11/1971 Dittrich ..... 427/447
6,025,034 A * 2/2000 Strutt et al. ..... 427/450

* cited by examiner

*Primary Examiner*—Kevin P Kerns
(74) *Attorney, Agent, or Firm*—Bruce A. Jagger

(57) ABSTRACT

A heterogeneous body having ceramic rich cermet regions in a more ductile metal matrix. The heterogeneous bodies are formed by thermal spray operations on metal substrates. The thermal spray operations apply heat to a cermet powder and project it onto a solid substrate. The cermet powder is composed of complex composite particles in which a ceramic-metallic core particle is coated with a matrix precursor. The cermet regions are generally comprised of complex ceramic-metallic composites that correspond approximately to the core particles. The cermet regions are approximately lenticular shaped with an average width that is at least approximately twice the average thickness. The cermet regions are imbedded within the matrix phase and generally isolated from one another. They have obverse and reverse surfaces. The matrix phase is formed from the matrix precursor coating on the core particles. The amount of heat applied during the formation of the heterogeneous body is controlled so that the core particles soften but do not become so fluid that they disperse throughout the matrix phase. The force of the impact on the surface of the substrate tends to flatten them. The flattened cermet regions tend to be approximately aligned with one another in the body.

10 Claims, 7 Drawing Sheets

26
31
40
29
36
42
45
43
44
47
36
32
34
30

Fig. 15
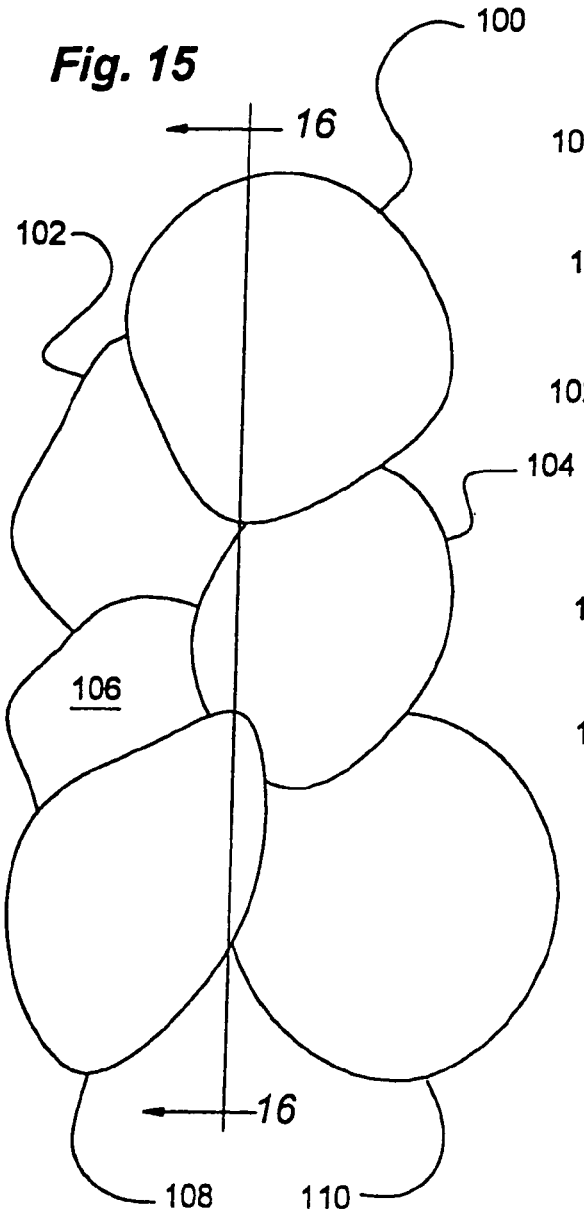
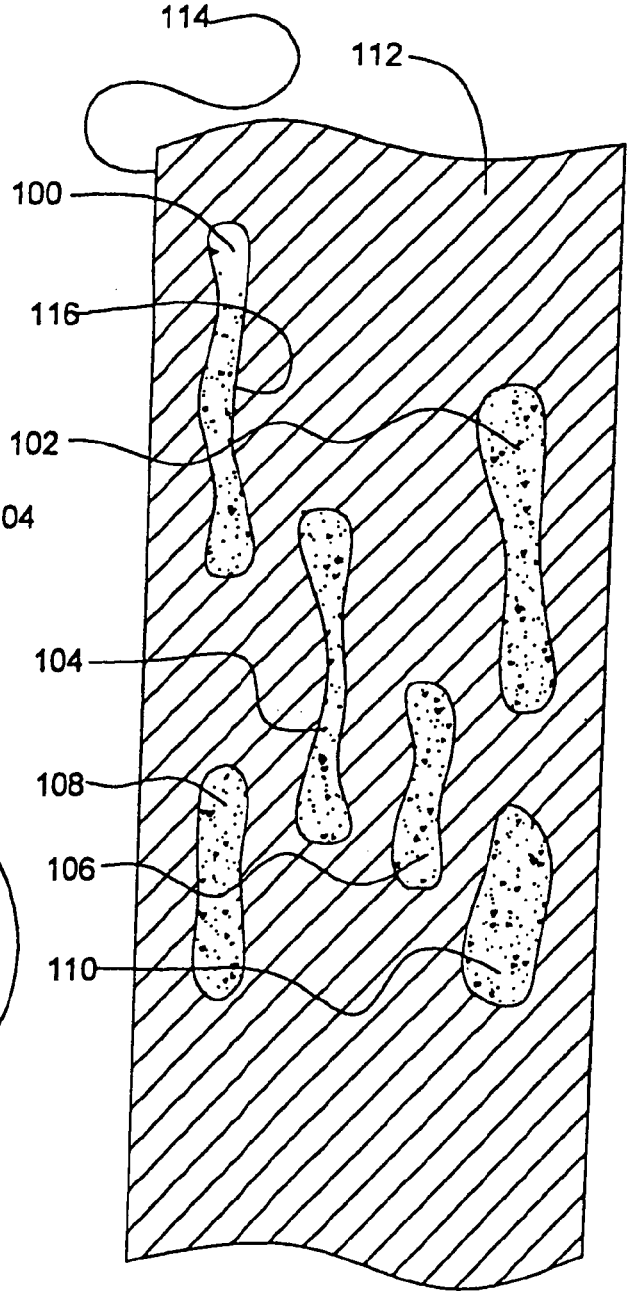
Fig. 16

Fig. 17
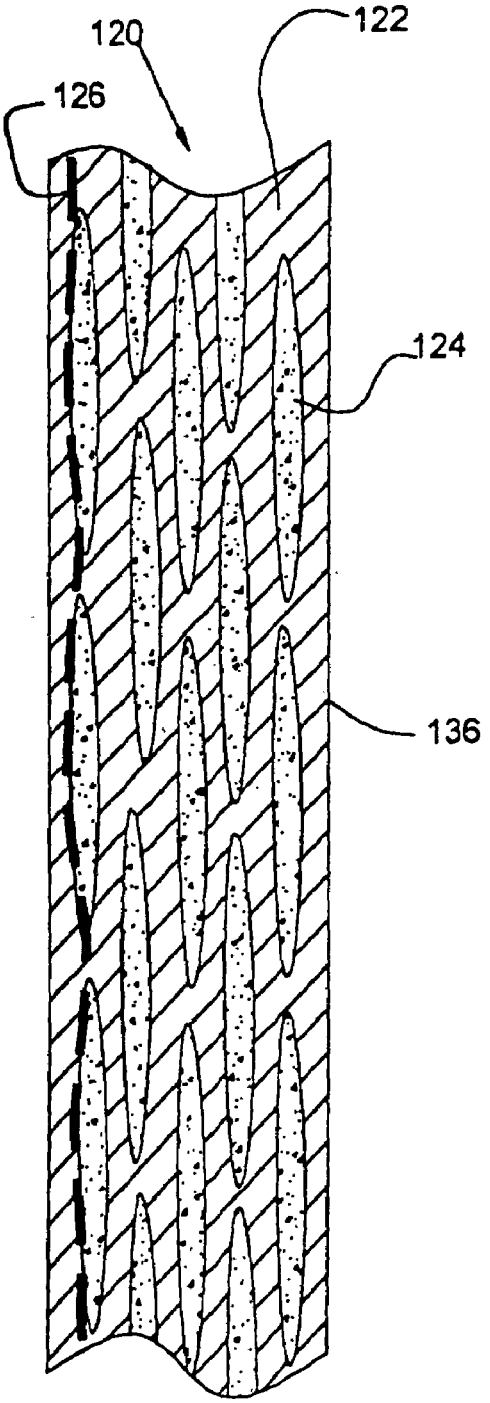
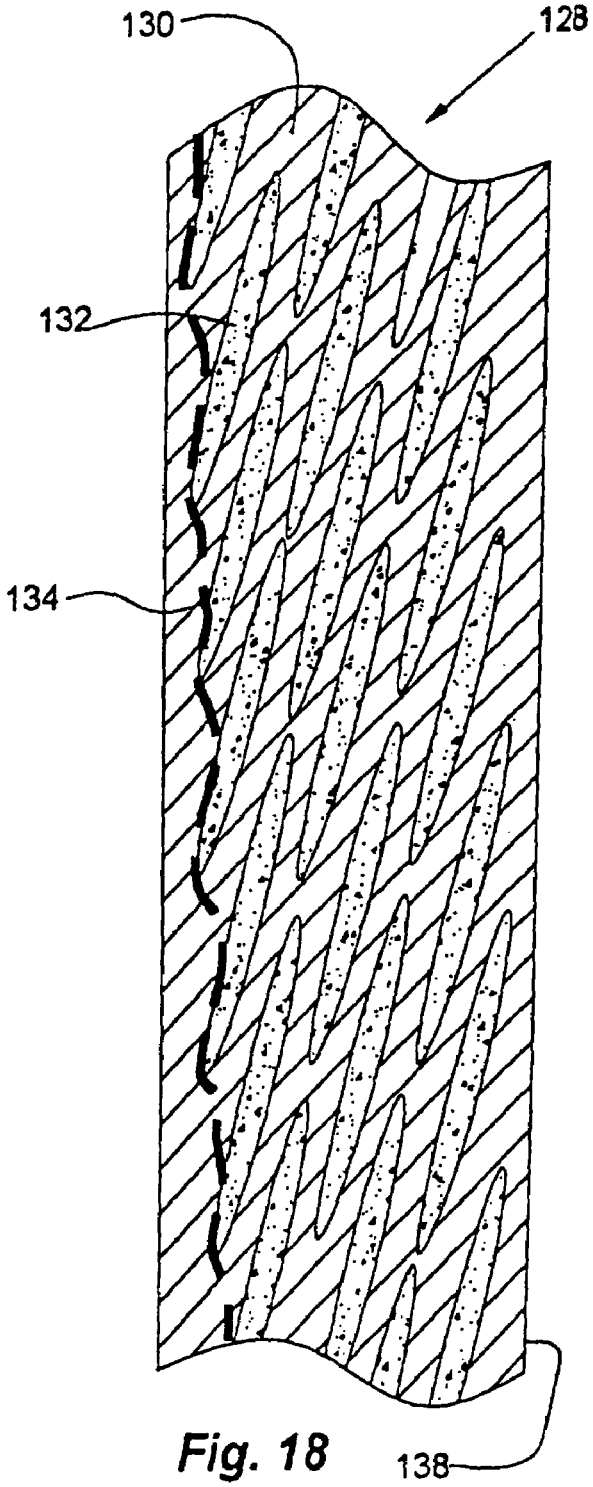
Fig. 18

HETEROGENEOUS COMPOSITE BODIES WITH ISOLATED LENTICULAR SHAPED CERMET REGIONS

RELATED APPLICATION

This application is a divisional application of Ser. No. 11/099,857, filed Apr. 6, 2005, which claims the benefit of Provisional Application Ser. No. 60/560,405, filed Apr. 8, 2004.

FIELD OF THE INVENTION

The invention relates in general to heterogeneous composites comprised of approximately lenticular shaped ceramic rich ceramic-metallic inclusions tightly bonded into a more ductile matrix. More particularly, the invention relates to heterogeneous composites having a bi-modal microstructure comprised of a matrix phase and a plurality of generally lenticular shaped cermet regions embedded in the matrix. The cermet regions are configured in a generally tiled but substantially separated relationship in so as to present a tightly bonded ceramic rich wear surface on a tough, impact resistant composite body. Further, the invention relates to coatings on metallic substrates, which coatings are formed by thermally spraying cermet powders under conditions where generally somewhat flattened, isolated, high aspect ceramic rich cermet regions or islands are formed in a ductile metal matrix.

DESCRIPTION OF THE PRIOR ART

It is well recognized that thermal sprayed cermet coatings can be produced from tungsten carbide-cobalt composites. See, for example, Dorfman U.S. Pat. No. 4,872,904 (−150+5 micron composite particles consisting primarily of tungsten carbide particles combined with some cobalt-tungsten carbide composite material for use as a thermal spray material in powder, wire or rod form); Hughes et al. U.S. Pat. No. 6,513,728 (alloyed refractory metal coating made using a cored wire electrode wherein the core material includes micron, sub-micron, and nano sized particles including cobalt coated micron sized tungsten carbide particles to which cobalt coated nano-sized tungsten carbide-cobalt particles are adhered, all of which may be coated with an optional metallic layer); Fang et al. U.S. Pat. No. 5,880,382 (double cemented carbide composite coating consisting of a plurality of hard phase regions in a second ductile phase, made by consolidating a plurality of tungsten carbide-cobalt composite particles in a matrix of cobalt under heat and pressure); and Jacobs et al. U.S. Pat. No. 4,956,012 (a pressed and sintered composite formed from a mixture of hard sub-micron 94 weight percent tungsten carbide-6 weight percent cobalt particles, and tough 3 to 6 micron 89 weight percent tungsten carbide-11 weight percent cobalt particles).

It had previously been proposed to form thermal sprayed coatings on substrates by milling or blending additives and modifiers using ball milling and attrition technology, and then to either sinter and crush or spray dry these materials into a powder suitable for application as a coating by thermal spraying. The thermal spray formed coatings are suitable for use in cutting tools, drilling and mining tools, aerospace components, and the like.

Prior thermal spray operations typically had as an objective the melting of at least the sprayed material, and often also the surface of the substrate. Thorough melting of the sprayed powder was generally believed to be beneficial and necessary because it improved the prospects for the formation of a metallurgical bond, as distinct from a mechanical bond, between the coating and the substrate. This thorough melting generally resulted in the composition of the coating being more or less uniform throughout. Typical prior thermal spray operations include, for example, HVOF (high velocity oxy-fuel), laser forming, plasma spray, plasma transfered arc, and the like.

Umeya et al. U.S. Pat. No. 5,489,449 discloses the use of ultrafine sintering aids dispersed/coated onto the surface of ceramic particles using precipitation techniques. They further describe a process for forming ultrafine ceramic particles through gas-phase nucleation which are then deposited onto the surfaces of ceramic particles. This is a homogeneous nucleation and deposition process resulting in a porous deposit of loosely bound particles on the surface of the particle.

Beane U.S. Pat. No. 5,453,293 disclose a related process for controlling the end intrinsic (CTE, thermal conductivity) properties of a material by forming a coated particle having two materials having distinctly different intrinsic properties, allowing the production of a material with a property controlled by rules of mixtures relationships between the limits set by the two materials consisting of the coating material and the core particle material.

Lee, et al. U.S. Pat. No. 4,063,907 disclose a process for producing smeared metal coatings on diamond particles to produce a chemically bonded coating on the diamond particles to improve adhesion in a matrix material.

Kuo et al. U.S. Pat. No. 5,008,132 disclose a process for applying a titanium nitride coating to silicon carbide particles using a diffusion barrier interlayer to improve the wettability and inhibit the reaction of the silicon carbide particles in a titanium metal matrix, and Gabor, et al. U.S. Pat. No. 4,505,720 disclose the use of refractory carbide and nitride coatings on abrasive particles.

Chance et al. U.S. Pat. No. 5,292,477 disclose an atomizing process for producing uniform distributions of grain growth control additives throughout the bulk of a particle, while Quick et al. U.S. Pat. No. 5,184,662 disclose a related process for forming metal/ceramic composite particles that have a continuous cladding of the metal.

It was well understood that the physical characteristics of cermets are balanced against one another to achieve the best compromise possible for a particular use. For example, it was generally believed that increasing the ceramic content of a cermet will increase the hardness and the wear resistance, but decreased the toughness and the impact resistance. Those skilled in the art recognized the need for a way to increase the hardness and wear resistance without decreasing the toughness and impact resistance.

Previously, various additives and modifiers had been proposed for various purposes in forming and using different cermet products. Such additives include, for example, wetting agents, grain growth inhibitors, melting point adjustment agents, and the like.

Large quantities of various cermet materials, particularly, cemented tungsten carbide tools, are scrapped because they are defective or worn beyond use for their intended purposes. These cermet materials contain valuable minerals. Reuse of these scrapped cermet materials would recover these valuable minerals at a considerable economic and environmental savings.

Tools such as metal cutting tools, rock boring tools, and the like are widely known and used. Such tools are typically constructed of hard wear resistant materials, or are at least faced with such materials. There is a well recognized need for such tools that exhibit harder and more wear resistant characteristics while at the same time possessing higher strength, toughness, and impact resistance. In general, hardness and wear resistance had to be sacrificed to increase strength, toughness and impact resistance.

These and other difficulties of the prior art have been overcome according to the present invention.

BRIEF SUMMARY OF THE INVENTION

A preferred embodiment of the heterogeneous bodies according to the present invention comprises a body formed from a cermet powder that is comprises complex composite particles. The complex composite particles are comprised of composite ceramic-metallic core particles that are coated with at least a ductile metal matrix precursor deposit or coating. The heterogeneous bodies are formed under conditions of applied heat and impact or force, preferably by thermal spraying, that transform the cermet powder and cause the coated composite ceramic-metallic core particles to form approximately lenticular shaped ceramic rich cermet regions embedded within a matrix phase. The cermet regions are formed from the composite ceramic-metallic core particles, and the matrix phase is formed from the ductile metal matrix precursor. The phrase "ceramic rich cermet regions" is sometimes shortened to "cermet regions" in this specification and the claims attached hereto. The phrase "ductile metal matrix phase" is sometimes shortened to "matrix phase" in this specification and the claims attached hereto. The phrase "composite ceramic-metallic core particle" is sometimes shortened to "composite core particle", or "core particle" in this specification and the claims attached hereto. The phrase "ductile metal matrix precursor" is sometimes shortened to "matrix precursor" in this specification and the claims attached hereto.

Preferably, all of the materials that go into the heterogeneous body are contained in the cermet powder. Thus, the composition and physical configuration of the heterogeneous body are at least primarily determined by the composition and configuration of the complex composite particles, together with the conditions under which the body is formed. The cermet regions are ceramic rich. That is, they are more than half ceramic. Preferably, the cermet regions contain at least approximately 75 weight percent ceramic in the form of ceramic particles. The composite ceramic-metallic core particles from which the cermet regions are formed likewise contain more than 50 weight percent and preferably more than approximately 75 weight percent ceramic in the form of ceramic particles. The matrix phase is metal rich. That is, it contains more than 50 and preferably more than approximately 75 weight percent metal. The metal rich ductile metal matrix precursor from which the matrix phase is formed likewise contains more than half and preferably more than approximately 75 weight percent metal.

The conditions of formation are such that rather than disperse throughout the matrix phase the composite ceramic-metallic core particles soften and deform to form somewhat flattened ceramic rich cermet regions. Preferably, the composite core particles are caused to impact on a substrate while in a softened state. This results in their deformation into approximately lenticular shapes. The degree of deformation depends on at least the degree of softening and the force of the impact. In general, the softer the composite core particle, the more the deformation. The nature of the ceramic particles and the metallic binder as well as their proportions in the core particle substantially influence the degree of deformation of the approximately lenticular shaped cermet regions.

Heat is provided during formation of the heterogeneous body to cause the desired degree of deformation, as well as to cause the desired matrix phase formation. The heat is limited so that the composite ceramic-metallic core particles retain their identity as somewhat flattened cermet regions. Conversely, enough heat must be provided to cause the matrix phase to form. Preferably, the matirx phase is substantially continuous and pore-free. The composition of the composite core particles and the ductile metal matrix precursor must be balanced so that the amount of heat required to form the isolated flattened cermet regions will also serve to form the desired matrix phase. The necessary heat can be provided, for example, by utilizing conventional thermal spray operations to form the heterogeneous bodies.

The ductile metal matrix precursor forms a matrix phase that anchors the cermet regions in the hetrogeneous body. It also serves to keep the approximately lenticular cermet regions isolated from one another within the heterogeneous body. The composite core particles deform by at least approximately two to one, and, preferably, form approximately five to one to twenty to one, during application, but retain their identity at least enough to define high ceramic content cermet regions substantially surrounded by a ductile metal matrix phase.

The matrix precursor coating or deposit on the composite core particles melts and flows sufficiently during formation to form a preferably pore-free matrix phase, but it does not become fluid enough to allow the cermet regions to contact or merge with one another to a significant degree. This requires careful control of the parameters of the formation process. Too much heat, for example, will totally melt the metallic binder in the composite core particle and the ceramic particles in the core particle will be released to become more or less uniformly distributed within the body of material. Such homogeneity, according to the present invention, is undesirable. Too little heat and the body will be weak and porous because the matrix phase has not properly formed. Also, if the composite core particles are not soft enough, they will not deform to the desired degree, or they may even not stick to the substrate to form part of a heterogeneous body. Changes in the composition of either the core particles or the matrix precursor will influence the formation of the body.

The parameters of the formation process are generally established by an iterative procedure. In general, it is necessary to form a heterogeneous body under known conditions, test and examine the resulting heterogeneous body, change one or more parameters in a controlled amount, and repeat the procedure until the desired heterogeneous body is produced.

For purposes of uniformity of the heterogeneous body, it is preferred that the composite ceramic-metallic core particles be substantially uniform in size and physical form. A generally spherical physical form is preferred because the resulting cermet regions tend to be more uniform in size, distribution and orientation within the heterogeneous body. Typically, each composite core particle forms one cermet region.

The ductile metal matrix precursor should be substantially uniform in composition and deposit thickness so as to maintain the desired uniformity of cermet region spacing, size, integrity, orientation and composition. The amount of material (thickness) in the matrix precursor deposit generally controls to a significant degree the spacing between the cermet regions. Increasing the thickness of the matrix precursor deposit on the composite ceramic-metallic core particles generally increases the amount of spacing between the ceramic rich cermet regions in the finished heterogeneous composite body.

The approximately lenticular shaped cermet regions are generally oriented with their longest dimensions approximately parallel to one another. The heterogeneous body is generally formed on a substrate. The approximately lenticular shaped cermet regions are generally, although not necessarily, oriented with their longest dimension approximately parallel to the surface of the substrate although other orientations are possible depending on the method of formation. The generally lenticular shaped cermet regions are isolated from one another but oriented so that they are layered or tiled within the coating.

As formed, a layer of approximately lenticular cermet regions is typically embedded slightly below the surface of a layer of the matrix phase. In use, the matrix phase layer over the cermet regions is usually quickly abraded away, thus exposing the top surfaces of the cermet regions. The thusly exposed obverse faces of the tiled cermet regions present a hard wear resistant surface that preferably covers substantially all of the heterogeneous body, and appears in plan view to be substantially continuous. The reverse faces of the cermet regions are firmly bonded over the entire width of the cermet region to the heterogeneous body. The isolated cermet regions are thus firmly bonded over a wide area by the matrix phase to the heterogeneous body. The toughness and impact resistance of the body are improved by the matrix phase, which in cross-section is generally substantially continuous.

The heterogeneous nature of the body provides substantial advantages. The heterogeneous bodies according to the present invention provide a tool with hardness and wear resistance characteristics, particularly when measured approximately parallel to the generally flattened cermet regions, that would require a much higher ceramic content if the body were homogeneous. At the same time, the heterogeneous body provides a tool with strength, toughness, and impact resistance characteristics that are much higher than would be possible with a homogeneous body that exhibits the same hardness and wear resistance. The wear resistance and hardness characteristics are generally asymmetrical in that they are generally significantly different, and usually less, when measured generally normal to the longest dimensions of the cermet regions as compared with the same measurements taken parallel to the longest dimensions. In general, the strength, toughness, and impact resistance characteristics of the heterogeneous body are also asymmetrical in that they tend to vary depending upon the direction in which they are measured. The asymmetrical physical characteristics of the body tend to follow the orientation of the cermet regions even when the body is arcuate or angular in configuration. Where the heterogeneous body is firmly bonded to a substrate, and the cermet regions are oriented generally parallel to the surface of the substrate, support is provided by the substrate and the toughness and impact resistance of the supported heterogeneous body are generally optimized.

The heterogeneous bodies of the present invention are typically formed in situ on a surface of a substrate. That is, the body forms in place from a fluid state as compared with being formed somewhere else, transferred to and applied to the surface of the substrate. Being formed in situ from a generally fluid state causes the body to bond as tightly as possible to the substrate. Where the bonding is mechanical, the formed in situ body conforms in minute detail to the supporting surface in a way that is impossible to achieve with a separately formed body. The in situ forming permits the body to conform to arcuate or angular surfaces, or surfaces where anchoring configurations or roughness have been deliberately provided.

The heterogeneous body is conveniently formed on a flat, arcuate, or angular surface of a substrate. The substrate typically has physical characteristics that differ from those of the heterogeneous body. Typically, the substrate supports and lends strength to the body, and the body provides wear resistance and hardness to the substrate. Substrates can be, for example, metallic, ceramic, cermet, polymeric, or the like. Where the heterogeneous body is intended to be separated from the substrate, the substrate can be a low melting alloy or a material that can be removed by leaching without harming the heterogeneous body, or the like. Where metallurgical bonding is required, the surface of the substrate can be coated with an adhesion promoter. Adhesion promoters include, for example, aluminum or other elements that form low melting alloys with the matrix precursor material in the cermet powder. Where mechanical bonds are to be formed, the bonding surface of the substrate can be roughened or porous.

The present invention is applicable to a wide variety of materials. The hard ceramic particles in the composite core particle can be, for example, the carbides, borides, oxides, and/or nitrides of W, Ti, Cr, Al, Mo, Si, Nb, Zr, or Ta. Mixtures of various hard ceramic particles can be used if desired. Tungsten carbide, for example, is widely used and widely available in the form of scrap cemented carbide tooling that may contain other hard materials such as titanium nitride, or the like, and a cobalt binder. Pulverized scrap cemented carbide tooling is suitable for use according to the present invention. Such scrap is preferred for use because it promotes the recycling of scarce and expensive raw materials. The present invention permits the use of a wide variety of raw materials. Since many of the advantages of the present invention are achieved because of the physical configuration of the heterogeneous body, a wide variety of different materials and mixtures of materials can be employed, as may be desired. The parameters of the operating system are determined for different materials by the previously described iterative process regardless of whether the raw material is scrap or virgin.

The metallic binder phase in the core ceramic-metallic composite particles can comprise, for example, Al, Ni, Fe, Co, Ti, mixtures and alloys thereof, and the like. Typically, the core ceramic-metallic composite particles, and the cermet regions formed from them have a metallic binder content of from approximately 3 to 15 weight percent based on the weight of the core particle. In an embodiment, the core ceramic-metallic composite particles include from approximately 7 to 40 volume percent ductile metallic binder.

The ductile metal matrix precursor deposit on the composite core particle can be, for example, in the form of a metal coating, a more or less loosely adhered deposit of particles, or the like. The matrix precursor can be, for example, metal, a metal rich cermet, or the like. Suitable metals for the metal content of the matrix precursor include, for example, Co, Fe, Ni, Ti, Al, Nb, mixtures and alloys thereof, and the like. The metal content in the matrix precursor is higher than the metallic content in the composite core powder.

The cermet regions in a heterogeneous body according to the present invention typically have an average width and an average thickness wherein the average width is at least twice the average thickness. The average width to thickness ratio is conveniently described as the aspect ratio of the cermet region. If all other variables are held constant, the aspect ratio of the cermet regions in a body will be proportional to the amount of heat applied to the cermet powder during the body forming operation. If all other variables are held constant, reducing the particle size of the complex composite particles in the cermet powder will reduce the aspect ratios of the cermet regions.

Aspect ratios of from approximately 2 to 1 to 20 to 1 or more are readily achievable by adjusting one or both of heat input and particle size. Under some circumstances, aspect ratios of as high as 100 to 1 may be achieved.

At aspect ratios of from approximately 2 to 1 to 5 to 1 the cermet regions will generally have a pronounced convex form. This is desirable, for example, where the abrading asperity that a heterogeneous body is intended to encounter in use are larger than the cermet region. In general, the larger the abrading asperity the lower the aspect ratio should be. For most intended applications the average aspect ratios of the cermet regions range from approximately 5 to 1 to 10 to 1. The average particle size of the ceramic particles in the cermet region must be much smaller than the abrading asperity.

The average size of the complex composite particles in the cermet powder is adjusted to accommodate the desired size of the cermet regions in the resulting heterogeneous body and the nature of the process that is used to form the body. Where large amounts of heat are used to form the body, as, for example, in a laser process, the particles must be large enough to retain their identity instead of completely melting and dispersing more or less uniformly throughout the body. With a laser process complex composite particles with average particle sizes of from approximately 1 to 5 millimeters are typically used. A thermal spray laser process has the advantage that sufficient heat is supplied to cause the melting that is generally required for a metallurgical bond to form between the substrate and the heterogeneous body. Where an HVOF (high velocity oxy fuel) thermal process is used, average complex composite particle sizes of from approximately 15 to 50 microns are preferably used.

The average width of the cermet regions within the heterogeneous bodies according to the present invention depends in part on the average size and degree of deformation of the composite core particles. Where a high heat process such as a laser process is used, some of the exterior of the composite core particle will melt and disperse into the matrix phase, thus reducing somewhat the detectable size of the cermet region. The average widths of the cermet regions generally range from approximately 20 to 6,000 microns, with average widths of from 50 to 500 microns being typical.

The average particle size of the ceramic particles within the composite ceramic-metallic core particle preferably range from approximately 0.1 to 10 microns, although average particle sizes of from approximately 0.01 to 50 microns can be employed in some circumstances.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of hard wear resistant structures. While the description which follows hereinafter is meant to be representative of a number of such applications, it is not exhaustive. As those skilled in the art will recognize, the basic methods and apparatus taught herein can be readily adapted to many uses.

It is applicant's intent that this specification and the claims appended hereto be accorded a breadth in keeping with the scope and spirit of the invention being disclosed despite what might appear to be limiting language imposed by the requirements of referring to the specific examples disclosed.

Figure 1:
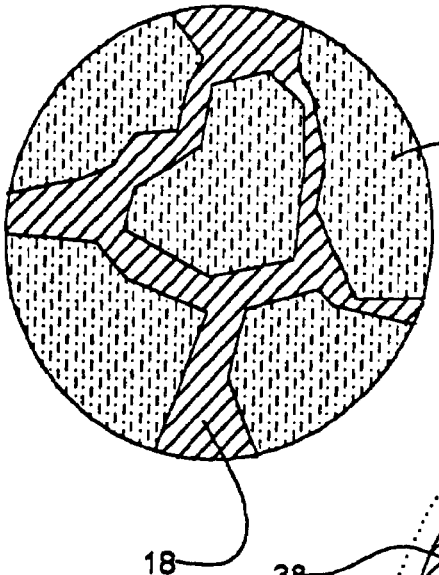

Referring particularly to the drawings for the purposes of illustration only and not limitation:

FIG. 1 is a diagrammatic cross-sectional view of a ceramic rich composite ceramic-metallic core particle according to the present invention in which the core particle has been spheroidized.

Figure 2:
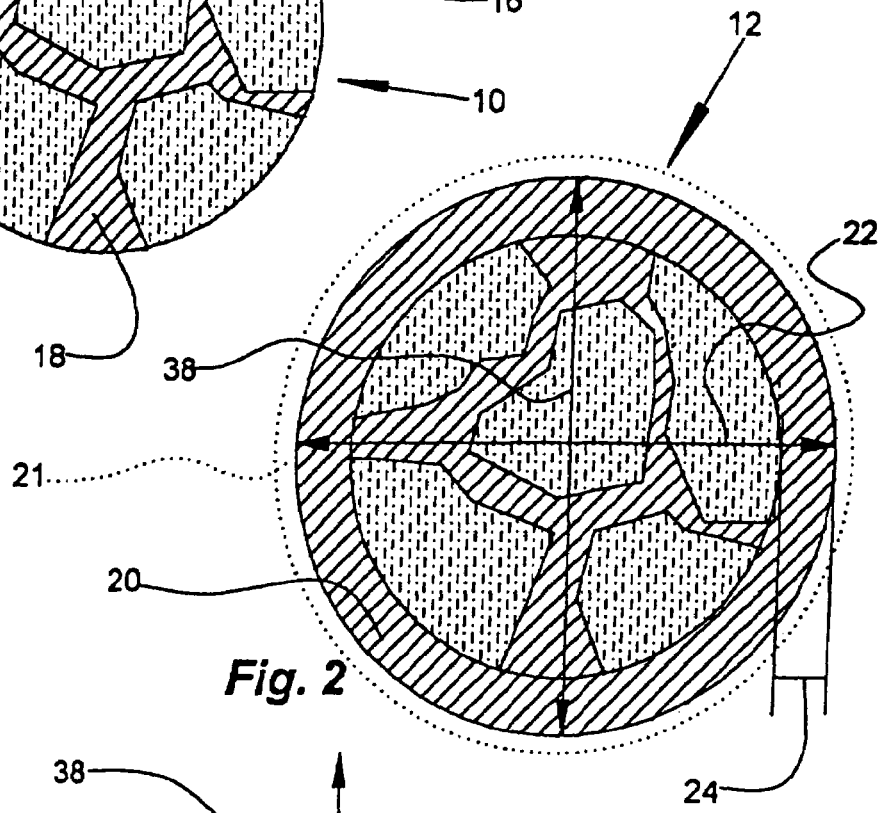

FIG. 2 is a diagrammatic cross-sectional view of a complex composite particle according to the present invention wherein the core particle of FIG. 1 has been coated with a metal rich ductile metal matrix precursor coating, and with an indication of possible additional coatings.

Figure 3:
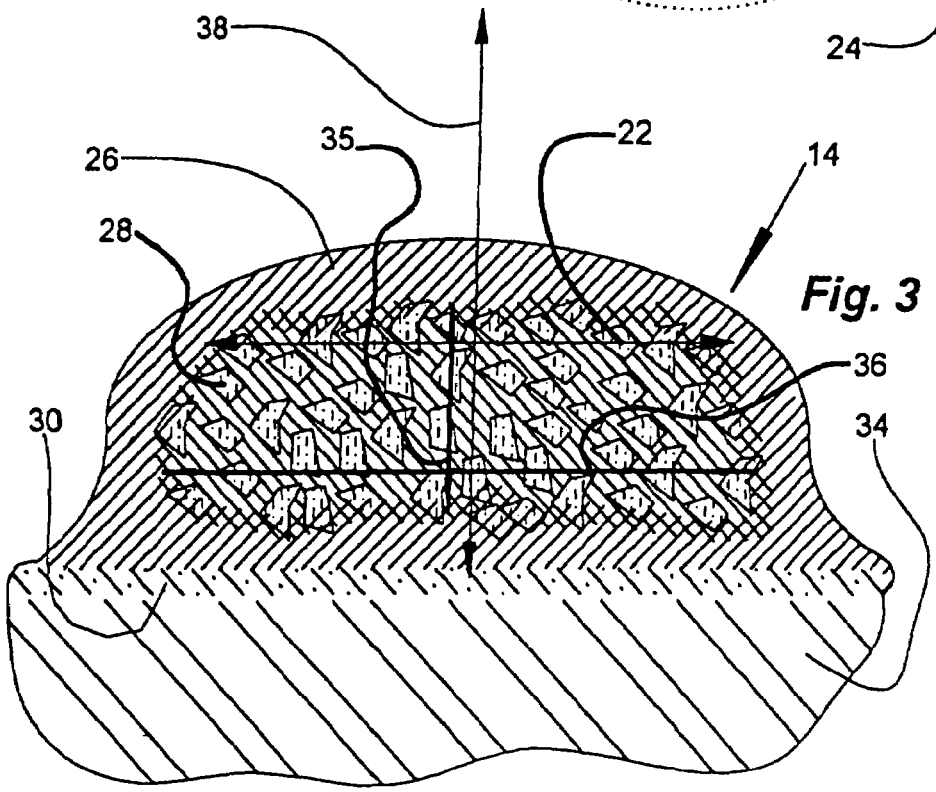

FIG. 3 is a diagrammatic cross-sectional view of a hetrogeneous body according to the present invention formed when the single complex composite particle of FIG. 2 is deposited at an elevated temperature onto a metal substrate to form an approximately lenticular shaped ceramic rich cermet region encapsulated within a metal rich ductile metal matrix, and indicating the aspect ratio of the deposited body is approximately 2 to 1.

Figure 4:
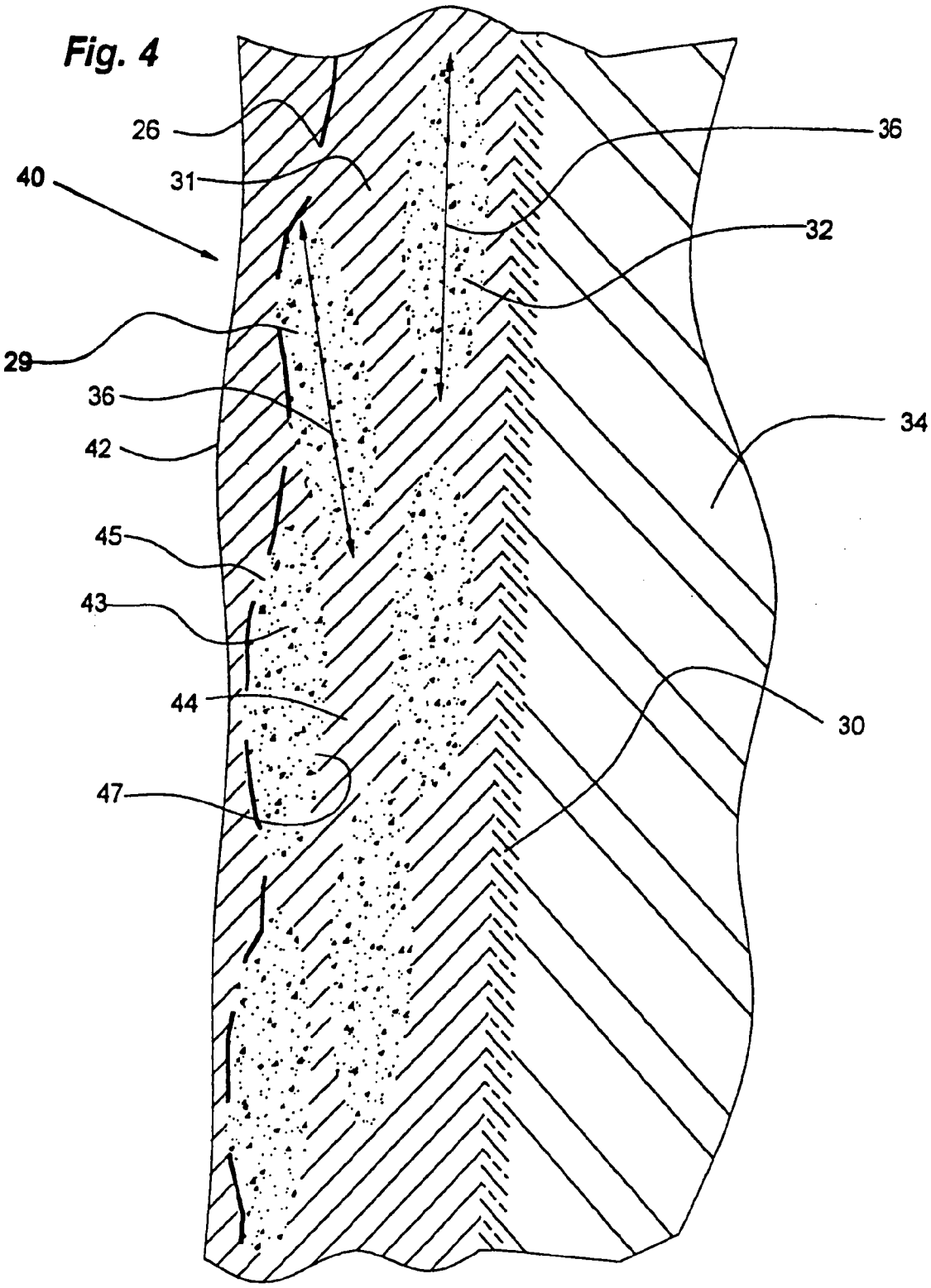

FIG. 4 is a diagrammatic cross-sectional view of a heterogeneous thermally sprayed coating formed in situ according to the present invention from a cermet powder comprised of, for example, complex composite particles similar to that diagrammatically illustrated in FIG. 2, and bonded to a surface of a metallic substrate wherein there are generally isolated high aspect ratio ceramic rich cermet regions embedded within a ductile metal matrix in a tiled fashion.

Figure 5:
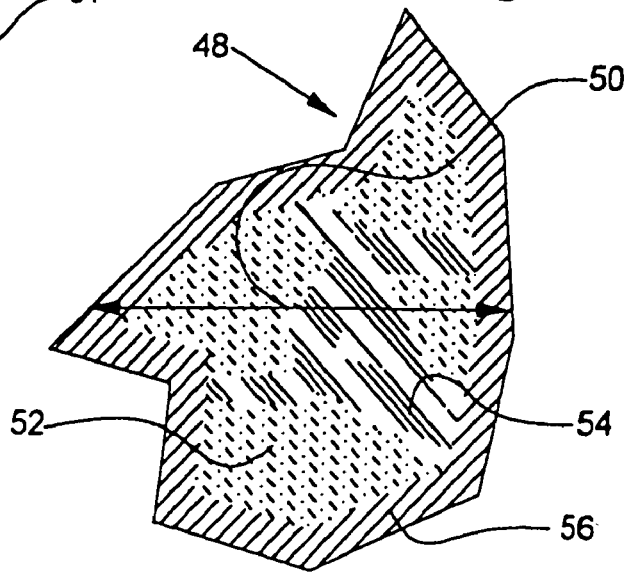

FIG. 5 is a diagrammatic cross-sectional view of an approximately spherical complex composite particle according to the present invention to which a layer of ductile metal matrix precursor has been applied.

Figure 6:
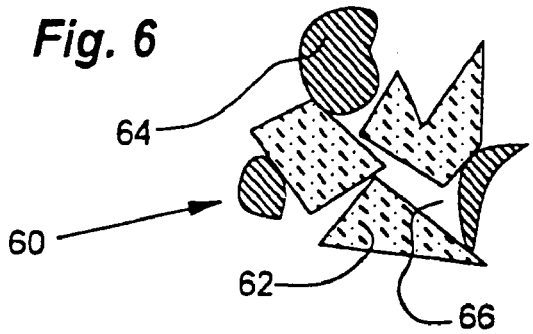

FIG. 6 is a diagrammatic cross-sectional view of a composite ceramic-metallic core particle composed according to the present invention of ceramic and metallic particles loosely bonded together.

Figure 7:
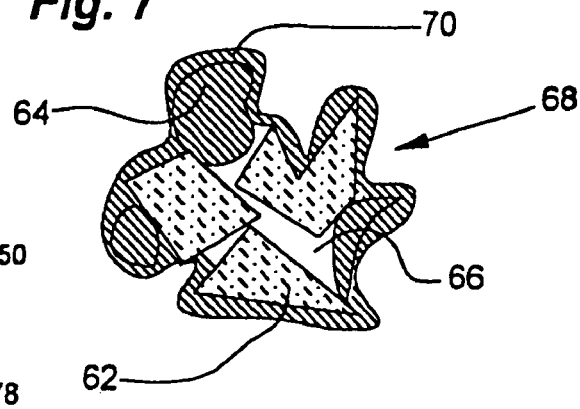

FIG. 7 is a diagrammatic cross-sectional view of the composite ceramic-metallic core particle of FIG. 6 to which a ductile metal matrix precursor coating has been applied according to the present invention to form an approximately spherical complex composite particle.

Figure 8:
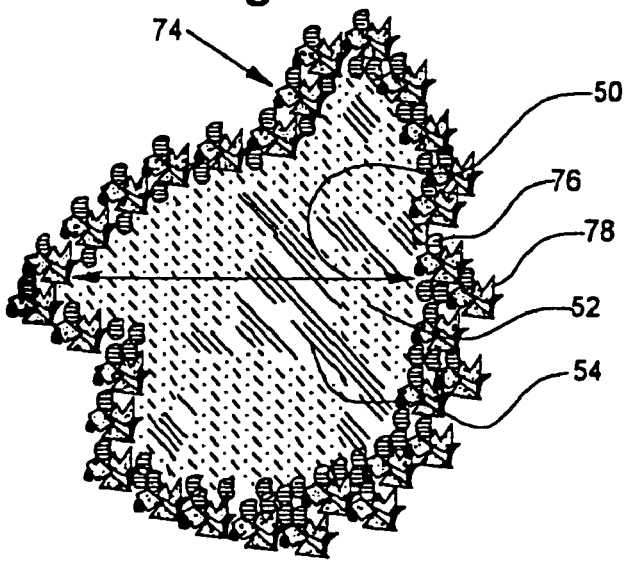

FIG. 8 is a diagrammatic cross-sectional view of an approximately spherical composite ceramic-metallic core particle according to the present invention coated with a plurality of small ceramic and metal particles. The small ceramic and metal particles comprise a ductile metal matrix precursor that will result in the formation of a ductile metal matrix that is comprised of a metal rich cermet.

Figure 9:
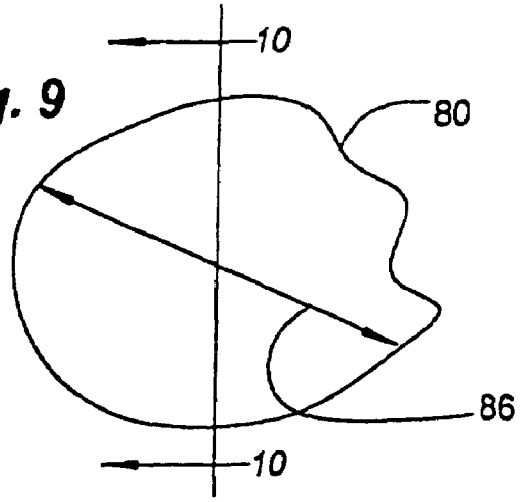

FIG. 9 is a diagrammatic plan view of a ceramic rich cermet region according to the present invention that would normally be embedded within a heterogeneous body, showing the outline of the form and the width of the region.

Figure 10:
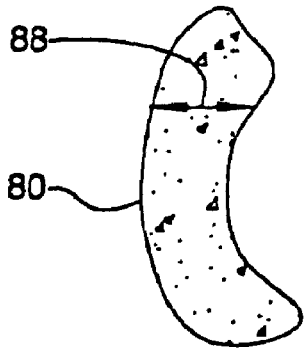

FIG. 10 is a diagrammatic cross-sectional view of the ceramic rich cermet region of FIG. 9 showing the form and thickness of the region.

Figure 11:
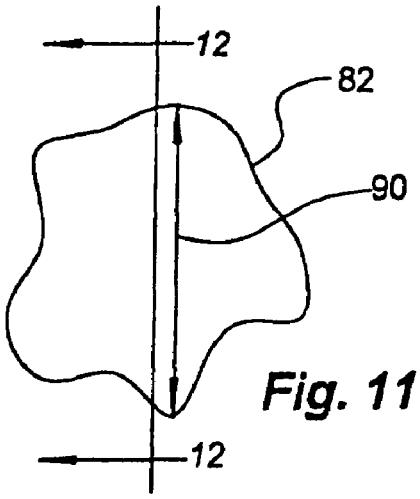

FIG. 11 is a diagrammatic plan view of an additional ceramic rich cermet region according to the present invention that would normally be embedded within a heterogeneous body, showing the outline of the form and the width of the region.

Figure 12:
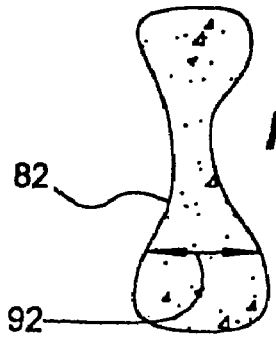

FIG. 12 is a diagrammatic cross-sectional view of the ceramic rich cermet region of FIG. 11 showing the form and thickness of the region.

Figure 13:
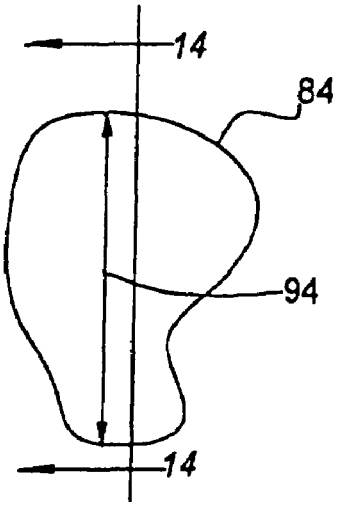

FIG. 13 diagrammatic plan view of an additional ceramic rich cermet region according to the present invention that would normally be embedded within a heterogeneous body, showing the outline of the form and the width of the region.

Figure 14:
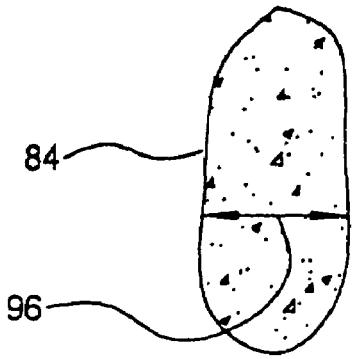

FIG. 14 is a diagrammatic cross-sectional view of the ceramic rich cermet region of FIG. 13 showing the form and thickness of the region.

FIG. 15 is a diagrammatic plan view of just a few of the ceramic rich cermet regions that would normally be embedded within a ductile metal matrix phase showing their overlapping (tiled) nature according to the present invention.

FIG. 16 is a diagrammatic cross-sectional view of the tiled ceramic rich cermet regions of FIG. 15 showing the cermet regions embedded within a matrix phase.

FIG. 17 is a diagrammatic cross-sectional view of a heterogeneous body according to the present invention in which a plurality of isolated cermet regions are embedded in a tiled configuration. The hard surface that is exposed by wear is indicated.

FIG. 18 is a diagrammatic cross-sectional view of a heterogeneous body according to the present invention in which a plurality of isolated cermet regions are embedded in a tiled configuration at a shallow angle to the surface of the heterogeneous body. The hard surface that is exposed by wear is indicated.

Figure 19:
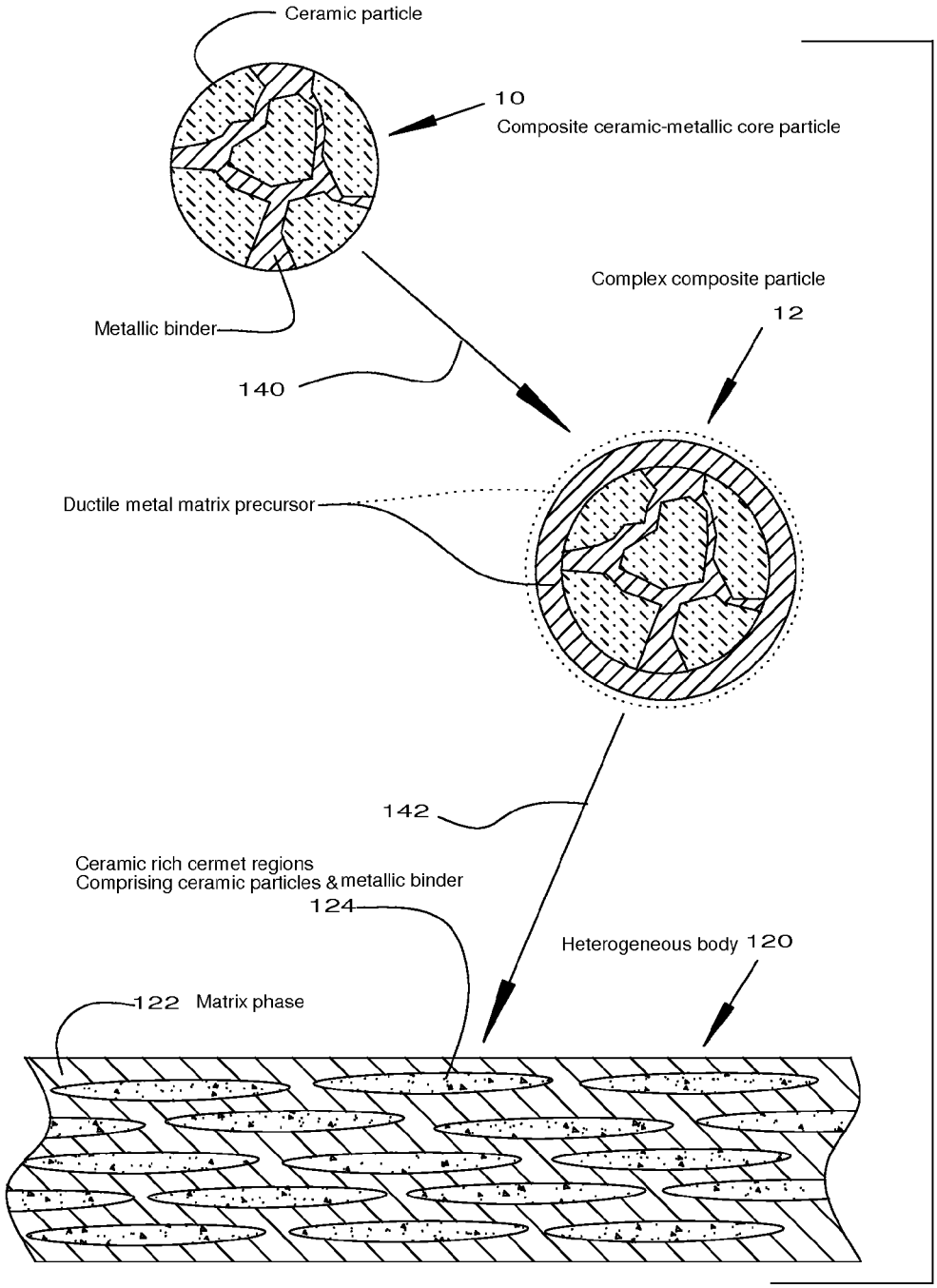

FIG. 19 is a diagrammatic cross-sectional view, which illustrates the steps according to the present invention by which the heterogeneous body of FIG. 17 containing a plurality of isolated and embedded substantially parallel cermet regions is formed.

DETAILED DESCRIPTION OF THE PREFERRED EMBODIMENTS

Referring now to the drawings wherein like reference numerals designate identical or corresponding parts throughout the several views, there is illustrated generally at 10 (FIG. 1) a core particle which has been spherodized. The core particle 10 is a ceramic rich composite ceramic-metallic core particle that is composed of ceramic particles 16 bonded together by a ductile metallic binder 18. Typically, there are a great many more ceramic particles in a single core particle 10. The number of ceramic particles is limited here so as to permit clear illustration of the components of the core particle. There is illustrated generally at 12 (FIG. 2) a complex composite particle wherein the core particle 10 is coated with a substantially uniform coating 20 composed of metal rich ductile metal matrix precursor. The thickness 24 of the coating 20 is sufficient to provide the desired amount of spacing between cermet regions in a heterogeneous body formed from a cermet powder composed of complex composite particles 12. Typically, the thickness 24 ranges from approximately 1 to 40, and, more preferably 1 to 10, percent of the diameter of the complex composite particle 12. The inclusion of optional modifiers and additives to the complex composite particle 12 is indicated at 21. Modifiers and additives typically serve to promote adhesion, or limit grain growth, or limit diffusion or reaction, or otherwise modify melting temperatures, physical, mechanical, or chemical properties, or the like. The provision, for example, of a layer of aluminum as the modifier 21 tends to reduce the melting point of the coating 20 and promotes the formation of a metallurgical bond with a substrate. The complex composite particle 12 is generally spherodized in that the width 22 is substantially equal to the thickness 38. There is indicated generally at 14 (FIG. 3) a flattened complex composite particle. Flattened particle 14 includes an approximately lenticular shaped cermet region and associated matrix phase formed from one complex composite particle. In practice it is generally impossible to isolate one complex composite particle and apply it alone to a substrate. This hypothetical situation is presented in FIG. 3 for the purposes of better illustrating the invention. The particle 12 has been softened but not completely melted, and impinged forcibly on metal substrate 34. The bond between the surface of substrate 34 and the ductile metal matrix 26 is indicated at 30. The strength of the bond 30 can range from one so weak that flattened particle 14 can be easily separated from the surface of the substrate to a metallurgical bond where the matrix phase 26 interdiffuses with and grades into the substrate 34. Chemical and mechanical bonds are also possible. The degree of deformation of the particle 12 is indicated by superimposing the width 22 and thickness 38 of particle 12 on the generally flattened particle 14. The aspect ratio of the cermet region in somewhat flattened particle 12 is approximately 2 to 1 as indicated by a comparison of the width 36 of the cermet region with the thickness 35 of the cermet region. This minimal degree of deformation produces a generally highly biconvex cermet region. As indicated, some interdiffusion between the matrix phase and the periphery of the cermet region occurs.

With particular reference to FIG. 4, there is indicated generally at 40 a cross-section of a thermal spray formed coating bonded at 30 to the surface of a substrate 34. The widths 36 of cermet regions 32 and 29 are indicated. The widths of the cermet regions are their longest dimensions. The cermet regions are oriented so that the longest dimensions are approximately parallel to one another. The cermet regions are not in exact alignment as illustrated, for example, by comparing the orientation of cermet regions 29 and 32. It will be understood by those skilled in the art that mathematical precision in alignment is not possible. In practice, approximate alignment is all that is possible. The advantages of the present invention are achieved by such approximate alignment. The matrix phase of coating 40 is indicated at 31. During use the upper surface 42 of the coating 40 is quickly worn away down to the normally outer surfaces of the cermet regions. The hard surface that is so exposed is indicated at 26. Cermet region 43 is typical. The rapid wearing away of surface 42 exposes the obverse face or surface 45 of cermet region 43. The reverse surface or face 47 of cermet region 43 is firmly bonded over its entire extent to the adjacent body of matrix phase 44. This extensive bonding area anchors the cermet region firmly in the coating. The area of the exposed obverse face 45 is approximately equal to the area of the bonded reverse face 47.

With particular reference to FIGS. 5 and 8, there is indicated generally at 48 and 74 complex composite particles with generally angular configurations. Particles 48 and 74 have configurations that are regarded as being approximately spherical for the purposes of the present invention. When softened and impinged on a solid surface, these particles will form approximately lenticular shaped cermet regions. The diameters of these approximately spherical particles are indicated at 50. With specific regard to complex composite particle 48, the composite ceramic-metallic core particle is composed of ceramic particles 52 and a metallic binder phase 54 that have been previously consolidated. The core particle is encapsulated in a generally continuous and uniform ductile metal matrix precursor coating 56. In the particle embodiment 74 of FIG. 8, the coating or deposit 56 on the core particle has been replaced with a coating or deposit of loosely bound fine particles. The fine particulate deposit includes metal particles 76 and ceramic particles 78. Other particulate components, for example, additives and modifiers can be included, if desired. The fine particulate particles typically have average particle sizes in the sub-micron range, for example, from approximately 0.01 to 1 micron, while the core particle typically has a particle size of from approximately 10 microns to 5 millimeters.

Attention is invited to FIGS. 6 and 7 wherein a composite ceramic-metallic core particle is indicated generally at 60, and a complex composite particle is indicated generally at 68. In particles 60 and 68 the ceramic particles 62 are loosely consolidated with metallic binder particles 64 so that there are voids 66 in the composite core particle. As much as 20 percent of the particle can be void volume, if desired. The core particle 60 is coated with an approximately uniform continuous deposit of matrix phase forming metal 70. The complex composite particle 68 is regarded as being approximately spherical for purposes of this invention because when softened and driven forcefully against a solid surface, the core particle will flatten and deform to an approximately lenticular shape.

With particular reference to FIGS. 9 through 14 there are illustrated a number of somewhat irregularly shaped cermet regions 80, 82 and 84. All of these cermet regions are considered for purposes of the present invention to be approximately lenticular shaped because they all serve to present hard wear surfaces that are oriented approximately parallel to one another in a heterogeneous body. Such cermet regions can be formed, for example, from particles such as those illustrated at 68, 48, and 74, which are only approximately spherical in shape. The widths of the obverse and reverse surfaces of cermet regions 80, 82, and 84 are illustrated at 86, 90, and 94, respectively. The thicknesses of cermet regions 80, 82, and 84 are illustrated at 88, 92, and 96 respectively. These widths and thicknesses are averages taken approximately over the irregular forms of these cermet regions. The concave-convex cross-section of cermet region 80, and the bi-concave cross-section of cermet region 82 can result from variations in the local instantaneous conditions that are encountered in the formation of the cermet regions. The bi-convex cross-section of cermet region 84 generally indicates that only the minimum amount of heat required to form a heterogeneous body, for the size of the complex composite particles in the cermet powder, was applied. For example, the particular particle from which cermet region 84 was formed may have been larger than the average particle in the cermet powder, or it may reflect the result of the formation process on the average sized particle in the cermet powder where minimum heat was applied.

FIGS. 15 and 16 illustrate the tiled configuration of a plurality of approximately lenticular shaped cermet regions 100, 102, 104, 106, 108, and 110 within a heterogeneous body. When viewed in plan view through the obverse surface 114 of the heterogeneous body, the overlapping cermet regions completely cover the reverse surface of the body. For purposes of clarity, only a few cermet regions are illustrated. Typically, there would be many more cermet regions embedded in matrix phase 112. It is evident that even with a relative wide spread in particle sizes so that the cermet regions differ considerably in size and aspect ratio, the desired hard wear resistant surface can still be formed on the body. This ability to accept variations in particle size and shape while still providing an entirely satisfactory body contributes significantly to the wide spectrum of utility and the desirability of the present invention.

FIGS. 17 and 18 illustrate typical heterogeneous bodies according to the present invention wherein the tiled cermet regions are oriented approximately parallel to one another and to the surfaces of the heterogeneous bodies 120 and 128, respectively. In the embodiment of FIG. 17 the heterogeneous body 120 is comprised of a matrix phase 122 in which approximately lenticular cermet regions, of which 124 is typical, are embedded. When the matrix phase material has been worn away from the obverse surface of body 120 so as to expose the hard obverse surfaces of the tiled cermet regions the exposed surface of the body 120 becomes located at line 126. The obverse surface 136 of body 120 is shown unsupported by any substrate. That is, in this embodiment the body 120 has been separated from the substrate so that it is free standing.

In the embodiment of FIG. 18 the tiled cermet regions, of which 132 is typical, are oriented with their obverse surfaces generally parallel to one another but only approximately parallel to the obverse and reverse surfaces of body 128. The orientation of the cermet regions in body 128 relative to the surfaces of the body 128 can occur, for example, as a result of the orientation of the source of heated cermet powder to the supporting substrate during the formation of the body 128, or the like. The wearing away of the matrix phase material to expose the obverse faces of the tiled cermet regions produces the wear face indicated at 134. Although potentially somewhat different from the wear surface 126 on body 120, the wear surface 134 functions satisfactorily for the purposes of the present invention. Similarly to reverse surface 136 in body 120, the reverse face 138 of body 128 is shown separated from the substrate upon which it was formed. Body 128 is intended for stand alone use.

FIG. 19 illustrates the steps in a thermal spray process by which heterogeneous body 120 is formed. A cermet powder comprising a plurality of complex composite particles 12 is selected. The particles 12 are formed by selecting approximately spherodized ceramic rich composite ceramic-metallic core particles 10, and applying a substantially uniform deposit of metal rich ductile metal matrix precursor as indicated by step 140. Optionally, additional deposits can be formed on core particle 10 to produce complex composite particle 12. Deposits can be formed by mechanical, chemical, elecrtrochemical, vapor deposition, agglomeration, sintering, or other conventional deposit forming procedures, as may be desired. Various processing steps carried out for the purposes of improving the integrity or other properties of the core particle or the components thereof, such as cleaning, activating, pre-coating, or the like, can be employed, if desired. The matrix precursor can be formed on the core particle in one or several sequential operations to deposit the same or different matrix precursor materials under the same or different conditions. The average particle size of the complex composite particle 12 is selected based on the nature of the body forming process and the desired size of the cermet regions in body 120. For example, for an HVOF thermal spray body forming process the average particle size is typically from approximately 5 to 75, and preferably, 15 to 60 microns.

The thermal spray or other body forming step is indicated at 142. The amount of heat applied to the cermet powder is controlled so as to produce body 120 in which isolated tiled cermet regions 124 are formed with approximately parallel obverse surfaces in metal matrix 122. A substrate serves to support the body 120 during formation. The softened core particles need a solid surface to impact against so as to induce the desired deformation. If removal of the body 120 from the substrate surface is desired, the substrate is selected so that separation by suitable means is facilitated. In general the cermet regions in body 120 grade into the matrix phase 122 so there is a boundary region where the matrix phase grades more or less continuously into the cermet region. Where as strong a bond as possible between the body and the substrate is desired, the conditions and composition of the matrix phase are adjusted so that a metallurgical bond is formed. In a metallurgical bond the microstructure at the interface between the body and the substrate is a blend of the two. The entire thickness of body 120 need not be formed in one single operation. Several forming steps can be carried out sequentially on one body using the same or a different cermet powder or conditions of deposition. The entire body need not be formed with a constant thickness. Arcuate and angular bodies can be formed depending upon the nature of the selected substrate.

In a preferred embodiment of the present invention, a high toughness and wear resistant cemented carbide coating is prepared by HVOF thermally spraying a cermet powder. The core WC-Co particles contain approximately 6 weight percent Co. Some solid solution carbides are present. The WC-Co core particles are derived from crushed scrap cemented carbides, including TiN coated tools. The core particles are coated with a higher cobalt content material. The complex composite particles are thermally sprayed to form a coating on a steel substrate. The resultant "duplex" WC-Co structure having low cobalt content particles embedded in a high cobalt content matrix phase exhibits improved strength and toughness and high wear resistance.

In a preferred embodiment, a plurality of a core particles comprised of WC-Co granules/particles having a particle size of about 10-35 microns and formed by spray-drying and sintering about 0.8-2 micron WC particles with about 6 weight percent of about 0.5-1 micron cobalt particles to form a slightly porous particle having micron-sized WC cemented together with about 6 weight percent cobalt and approximately 10 percent porosity. See FIG. 6. To this first material a matrix precursor of pure cobalt is applied to the outer surface to a thickness of approximately 0.5 microns (or about 6 additional weight percent cobalt). See FIG. 7. These 6 weight percent cobalt-coated, spray-dried WC-6 weight percent Co particles are then sprayed onto a steel substrate using an HVOF (high velocity oxy-fuel) gun to form a coating of about 88 weight percent WC, about 12 weight percent Co and having a duplex structure of WC-Co islands or cermet regions having high hardness and lower cobalt content, separated by regions having lower hardness and higher cobalt content.

In a further preferred embodiment, scrap cemented carbide tooling containing approximately 1 weight percent Ti in solution and having a cobalt content of approximately 7 weight percent is crushed and sized into a −325 mesh, +5 micron distribution with an average particle size of about 25 microns. These particles are loaded into a fluidized bed and coated with approximately 0.8 micron of cobalt metal (10 weight percent). The coated, crushed carbide particles are applied via HVOF to a steel substrate where they produce a carbide coating with a deposition efficiency exceeding 50 percent (more than 50 percent of the particles became part of the coating), and having a microstructure characterized by splats of high hardness low cobalt content islands or cermet regions surrounded by a high cobalt content matrix phase.

In an additional preferred embodiment, scrap carbide containing about 3 weight percent cobalt and having approximately 1 weight percent Ti by weight as a solid solution carbide is crushed and sized to form about a 200 (75 micron) grit material. These particles are plasma spheroidized, and then coated with a roughly 2 micron coating of pure cobalt to yield about 12 percent total cobalt by weight. The spheroidized, cobalt-coated granules are then applied and fused directly onto a steel component using a laser to form a bonded structure having about 50-70 micron "hard" cermet islands in a cobalt-enhanced matrix phase.

In another preferred embodiment, scrap carbide containing about 3 weight percent cobalt is crushed and sized to about a 200 grit first material. A blend of about 0.8 micron WC and about 12 weight percent cobalt is blended in an attrition mill, mixed with a binder and solvent, and applied to the surface of the first material and then sintered at about 1200 degrees centigrade to drive off the binder and cement the outer coating to the first material. See FIG. 8. The resultant duplex particles are fed through a plasma transferred arc gun and applied to steel substrates to provide a thick coating (about 0.060 inches) with a structure comprised of hard, low cobalt content cermet regions embedded in a tough, higher cobalt content matrix phase.

Where the core particle is comprised of WC-Co, the particle preferably contains from between about 70 and 97 weight percent WC and between from about 3 and 30 weight percent cobalt. Where both the core particle and the matrix precursor are composed of WC-Co, the core particle preferably contains from approximately 93 to 97 weight percent WC, and from approximately 3 to 7 weight percent Co, and the matrix precursor contains from about 70 to 90 weight percent WC and about 10 to 30 weight percent CO. From approximately 1 to 5 weight percent of the WC can be replaced by Ti or Nb. A particularly preferred complex composite particle is one composed of a WC-Co core particle containing from approximately 3 to 9 weight percent Co, and a matrix precursor coating containing about 100 percent Co, or from approximately 10 to 30 weight percent Co with the balance being WC. Where the metal content in the matrix precursor is less than the ceramic content, it is important that the metal content of the matrix precursor be greater than the metal content of the core particle by at least approximately 5 and preferably 10 weight percent. Core particles containing $Cr_3C_2$ and a metal, for example, between about 5 and 20 weight percent Ni coated with a matrix precursor containing, for example, from between about 30 and 50 weight percent nickel with the balance being $Cr_3C_2$ are well suited for use according to the present invention. Suitable ceramic particles also include those comprised, for example, of high carbon ferrochrome, high carbon ferrotitanium, and high carbon ferrotungsten.

The core particles can contain a mixture of hard particles such as, for example, two or more carbides, borides, oxides, and/or nitrides of different metals or similar metals in different ceramics. Likewise, the metallic binders in the core particle can be composed of mixtures of different metals and their alloys. The matrix precursors can also contain mixtures of different metals and hard phase materials so long as the matrix as formed in the body is more ductile than the cermet regions so that the properties of the cermet regions provide higher wear resistance than the matrix phase.

The matrix phase is ductile in the sense that it is more ductile than the cermet regions. For some applications the matrix phase may need to be very wear resistant in its own right. This generally requires that it contain a significant proportion of hard material, often in solution.

As used herein those skilled in the art will understand the term "graded" to mean that there is some inter diffusion at the boundaries where the composition of the adjacent regions vary in a more or less continuous fashion from all one region to all the other region.

The average particle sizes of the complex composite particles typically range from approximately 1-600, preferably 5-500 microns, those of the composite core particles from approximately 1-600, preferably 5-500 microns, those of the ceramic particles within the core particles from approximately 0.01-50, preferably 0.1-10 microns, and those of the fine particle coating particles as shown for example in FIG. 8, less than approximately one tenth of the core particle's diameter. Proportioning of average ceramic particle size to the average composite core particle size is generally such that the average ceramic particle size is less than about one-fifth that of the core particle. Typically, the cermet regions comprise from approximately 30 to 95, preferably 60-93, volume percent of the heterogeneous bodies, with the balance being matrix phase material. Typically, the ceramic rich cermet regions are comprised of from approximately 5 to 50 volume percent ductile metallic binder, and have an average width of from approximately 5 to 600 microns.

Embodiments include an heterogeneous body having a surface and ceramic rich cermet regions that generally comprise ceramic particles having an average particle size of from approximately 0.01 to 50 microns, and metallic binder. The ceramic rich cermet regions are approximately lenticular shaped and have an average thickness and an average width. The average width is at least approximately twice the average thickness. The ceramic rich cermet regions are generally isolated from one another, and they have obverse and reverse surfaces. The ceramic rich cermet regions are embedded within a metal containing matrix phase. At least a majority of the ceramic rich cermet regions are oriented with at least one of the obverse and reverse surfaces approximately parallel to one another. Each of said ceramic rich cermet regions includes a number of the ceramic particles. The matrix phase is more ductile than the ceramic rich cermet regions.

Embodiments include an heterogeneous body having a surface and ceramic rich cermet regions. The ceramic in the ceramic rich cermet regions is selected from the group consisting of WX, TiX, CrX, AlX, MoX, SiX, NbX, ZrX, TaX, mixtures, and alloys thereof, and X is selected from the group consisting of C, B, N, 0, and mixtures thereof. Each of the ceramic rich cermet regions including a number of ceramic particles, and a metallic binder. The ceramic rich cermet regions are approximately lenticular shaped and have an average thickness and an average width. The average width is at least approximately twice the average thickness. The ceramic rich cermet regions are generally isolated from one another and embedded within a ductile metal containing matrix phase. The matrix phase is selected from the group consisting of Co, Ni, Ti, Al, Fe, Nb, mixtures, and alloys thereof. At least a majority of the ceramic rich cermet regions are oriented with their widths approximately parallel to one another. The ceramic rich cermet regions are more than half ceramic.

What have been described are preferred embodiments in which modifications and changes may be made without departing from the spirit and scope of the accompanying claims. Clearly, many modifications and variations of the present invention are possible in light of the above teachings. It is therefore to be understood that, within the scope of the appended claims, the invention may be practiced otherwise than as specifically described.

What is claimed is:

1. A method of thermal spray forming a heterogeneous coating in situ on a surface of a metallic substrate, said method comprising:

selecting a cermet powder comprised of complex composite particles, said complex composite particles having an average particle size and comprising a core ceramic-metallic composite particle substantially encapsulated within ductile metal matrix precursor, said complex composite particles having an average particle size of from approximately 1 to 600 microns, said core ceramic-metallic composite particle comprising at least ceramic particles and a ductile metallic binder;

establishing a thermal spray of said cermet powder wherein said ductile metallic binder and ductile metal matrix precursor are at least softened and said core ceramic-metallic composite particles substantially retain their individual identities;

impinging said thermal spray of cermet powder with a force on said surface, said force being sufficient to cause said core ceramic-metallic composite particles to form approximately lenticular shaped ceramic rich cermet regions in a ductile metal matrix, said ductile metal matrix being substantially continuous and substantially formed from said ductile metal matrix precursor, said ceramic rich cermet regions being generally isolated from one another, embedded within said ductile metal matrix, and having a average width and an average thickness, said average width being at least approximately twice said average thickness, said approximately lenticular shaped ceramic rich cermet regions being oriented approximately parallel to one another; and recovering a said heterogeneous coating wherein said approximately lenticular shaped ceramic rich cermet regions comprise from approximately 30 to 95 volume percent of said heterogeneous coating with the balance of said heterogeneous coating being said ductile metal matrix.

2. A method of claim 1 including selecting complex composite particles having an average particle size of from approximately 5 to 60 microns and an approximately spherical shape.

3. A method of claim 1 including impinging said thermal spray of cermet powder on said surface to form said approximately lenticular shaped ceramic rich cermet regions oriented approximately parallel to said surface.

4. A method of claim 1 including selecting complex composite particles comprised of WC-Co.

5. A method of claim 1 including selecting a ductile metal matrix precursor comprising Co.

6. A method of claim 1 including selecting said complex composite particles wherein said ductile metal matrix precursor has an average thickness of from about 1 to 40 percent of said average complex composite particle size.

7. A method of claim 1 including selecting core ceramic-metal composite particles including from approximately 7 to 40 volume percent ductile metallic binder.

8. A method of claim 1 including causing said thermal spray of cermet powder to form ceramic rich cermet regions wherein said average width is no more than approximately 20 times said average thickness.

9. A method of claim 1 including separating said recovered heterogeneous body from said surface.

10. A method of thermal spray forming a heterogeneous coating in situ on a surface of a substrate, said method comprising:

selecting a cermet powder comprised of complex composite particles, said complex composite particles having an average particle size and comprising a core ceramic-metallic composite particle substantially encapsulated within ductile metal matrix precursor, said ductile metal matrix precursor having an average thickness on said core ceramic-metallic composite particle of from approximately 1 to 10 percent of a diameter of said complex composite particle, said complex composite particles having an average particle size of from approximately 1 to 600 microns, said core ceramic-metallic composite particle comprising at least ceramic particles and a ductile metallic binder;

establishing a thermal spray of said cermet powder wherein said ductile metallic binder and ductile metal matrix precursor are at least softened and said core ceramic-metallic composite particles substantially retain their individual identities;

impinging said thermal spray of cermet powder with a force on said surface, said force being sufficient to cause said core ceramic-metallic composite particles to form approximately lenticular shaped ceramic rich cermet regions in a ductile metal matrix, said ductile metal matrix being substantially continuous and substantially formed from said ductile metal matrix precursor, said ceramic rich cermet regions being generally isolated from one another, embedded within said ductile metal matrix, and having a average width and an average thickness, said average width being at least approximately twice said average thickness, said approximately lenticular shaped ceramic rich cermet regions being oriented approximately parallel to one another; and recovering a said heterogeneous coating wherein said approximately lenticular shaped ceramic rich cermet regions comprise from approximately 60 to 93 volume percent of said heterogeneous coating with the balance of said heterogeneous coating being said ductile metal matrix.

* * * * *